United States Patent [19]

Knight

[11] Patent Number: 4,824,091

[45] Date of Patent: Apr. 25, 1989

[54] SHEET COLLECTION DEVICES AND SHEET PROCESSORS UTILIZING SAME

[75] Inventor: Margaret A. Knight, Welwyn Garden, United Kingdom

[73] Assignee: Xerox Corporation, Stamford, Conn.

[21] Appl. No.: 511,036

[22] Filed: Jul. 5, 1983

[30] Foreign Application Priority Data

Jul. 7, 1982 [GB] United Kingdom ..... 8219711

[51] Int. Cl.[4] ..... B65H 29/40

[52] U.S. Cl. ..... 271/178; 271/207

[58] Field of Search ..... 271/314, 177, 178, 207, 271/272, 273, 274

[56] References Cited

U.S. PATENT DOCUMENTS

| | | | |
|---|---|---|---|
| 2,827,294 | 3/1958 | Smith | 271/178 |
| 2,925,271 | 2/1960 | Faeber | 271/178 |
| 3,046,010 | 7/1962 | Schneider | 271/223 |
| 3,228,273 | 1/1966 | Hoffman | 271/314 |
| 3,556,512 | 1/1971 | Fackler | 271/4 |
| 3,840,224 | 10/1974 | Zawiski | 271/273 |
| 3,981,446 | 9/1976 | Jensen et al. | 271/314 |
| 4,056,264 | 11/1977 | Dhooge et al. | 271/314 |
| 4,065,123 | 12/1977 | Arrasmith et al. | 271/215 |
| 4,092,099 | 5/1978 | Chiba et al. | 271/314 |

FOREIGN PATENT DOCUMENTS

| | | | |
|---|---|---|---|
| 0212545 | 12/1983 | Japan | 271/314 |
| 2091220 | 7/1982 | United Kingdom . | |

*Primary Examiner*—Joseph J. Rolla

*Attorney, Agent, or Firm*—William A. Henry, II

[57] ABSTRACT

A sheet collection device having a stack support surface and a registration stop for aligning the edges of the sheets being stacked on the support surface so as to engage the trail ends of sheets as they are received on the support surface. The brushes are driven so that the bristles thereof wipe downwardly against the sheet trail ends. The brushes may alternatively be incorporated at the exit of a sheet processor.

5 Claims, 6 Drawing Sheets

SHEET COLLECTION DEVICES AND SHEET PROCESSORS UTILIZING SAME

Figure 1:
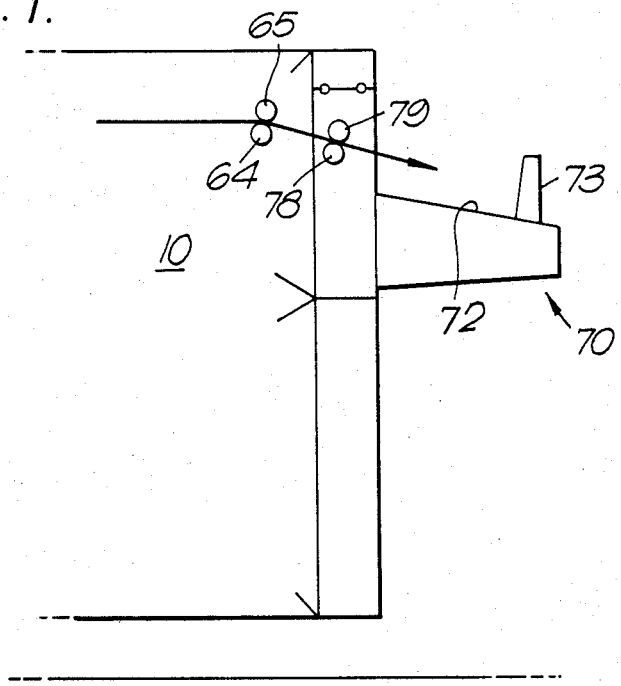

This invention relates sheet collection devices and to sheet processors which utilise such devices, either incorporating them or being adapted to have such devices mounted thereto.

Sheet collection devices are used in many situations where sheets are fed out for collection, for example in printing, photocopying or duplicating machines. The collection device, which is generally arranged to receive sheets from the exit rollers or chute of the machine may take various forms. It may for example be a simple catch tray or it may include a stack support surface which can be elevated so as to keep the top of the stack being formed at a substantially constant height. Also it may take the form of a compiler station for a finishing apparatus in which sheets are compiled into sets and the sets further treated by being stapled or punched.

Usually the sheets entering the collection device are registered by being fed against a registration stop so that such collection devices are often referred to as stackers. Either the lead edges of the sheets are registered against a front stop (lead-edge registration) or the rear edges are registered against a back stop (trail-edge registration). In the latter case particularly, the support surface is often inclined downwardly towards the registration stop. The sheets fall downwards as they enter the device and where the sheets are curled, the trail ends of the sheets may not stack flat so that the capacity of the device is reduced by sheets in the collection device interfering with incoming sheets. In order to alleviate this problem it has been proposed to mount rotating rubber or plastic paddles or flappers at the input end of the support surface, which repeatedly wipe downwardly against the trail ends of sheets being stacked. Such devices are used commercially for example in the Xerox 3100 and 2600 photocopiers made by the Applicant Company where the flappers are made of rubber. (Xerox is a Registered Trade Mark.) It has been found however that such devices tend to damage the sheets particularly when run at the high speeds which are necessary when the sheets are being delivered at a high rate and to be noisy.

In accordance with the present invention, one or more brushes are arranged at the input end of the support surface and driven so as to wipe downwardly against the trail ends of sheets received on the support surface.

By wiping downwardly against the top of the stack the brush holds down the trail ends of the sheets and ensures that they do not interfere with sheets entering the collection device. It will be understood that for the purpose of avoiding sheets already in the collection device from interfering with incoming sheets it is not necessary that the bristles of the brush be long enough to wipe those sheets in the lower part of the stack firmly against the stack, although in order to reduce curl and improve registration this may be desirable. The length of the bristles will to some extent depend on the location and type of the brush. Thus the brush may take the form of a rotatable hub having bristles projecting generally radially outwardly therefrom. Such a brush may be fixed in position relative to the support surface in which case, depending on the depth of the collection device and the length of the bristles, it may not wipe sheets firmly against the stack until the stack has built up to a certain height. It will however wipe against all the sheets as they settle in the collection device. In the case of an elevating stacker in which the elevation of the support surface is automatically adjusted in dependence upon the height of the stack, the average distance of the brush above the top of the stack may be reduced. Instead of being mounted on a hub the bristles may project outwardly from an endless belt or the like arranged at the back of the support surface and extending normally thereto. Such a belt may extend over the entire stack height of the collection device.

Sheet collection devices generally have one or more pairs of nip rollers mounted on shafts at the input end of the support surface for conveying sheets on to the support surface. In one preferred form one or more brushes of this invention are mounted on the lower nip roller shaft. A brush of the a hub type may be mounted on the shaft for rotation therewith and a brush of the endless belt type may have the belt entrained over a first roller mounted on the shaft for rotation therewith and a second roller below the first roller. Such an arrangement provides two additional advantages. Firstly the brush tends to corrugate the sheet as it passes through the nip rollers, thus increasing its beam strength and facilitating its entry onto the stack. Secondly the brush engages the trail edge of the sheet as it leaves the nip rollers so as to assist in driving the sheet on to the stack.

The bristles of a brush used in this invention may be of natural or synthetic fibre, and a suitable synthetic material is a nylon such as Rilsan. Suitably the bristles are arranged in tufts, for example a circular brush may have twelve tufts arranged around its circumference, with between 200 and 480 bristles or filaments in each tuft.

It will be realised that the input nip rollers of a sheet collection device as described above may instead of forming part of the sheet collection device itself, be arranged at the exit of the sheet processor from which the sheet collection device receives the sheets.

Thus, from another aspect, there is provided a sheet processor having a sheet exit, means for mounting a sheet collection device so as to receive sheets exiting said processor, coacting upper and lower nip rollers at said exit for driving sheets into a sheet collecting device and one or more rotatable brushes for wiping downwardly against the trail ends of sheets exiting said nip rollers, said brushes being mounted coaxially with said lower nip roller(s) for rotation therewith.

Figure 2:
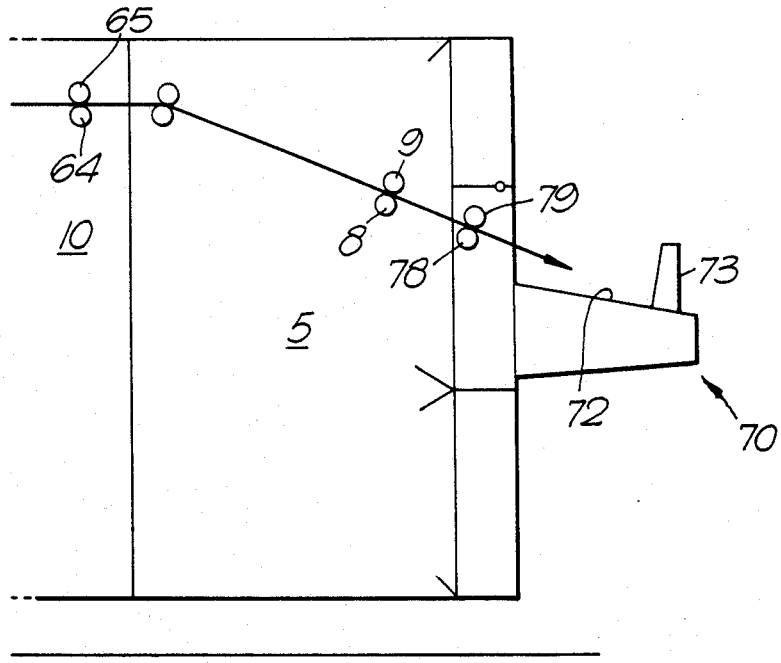
Figure 3:
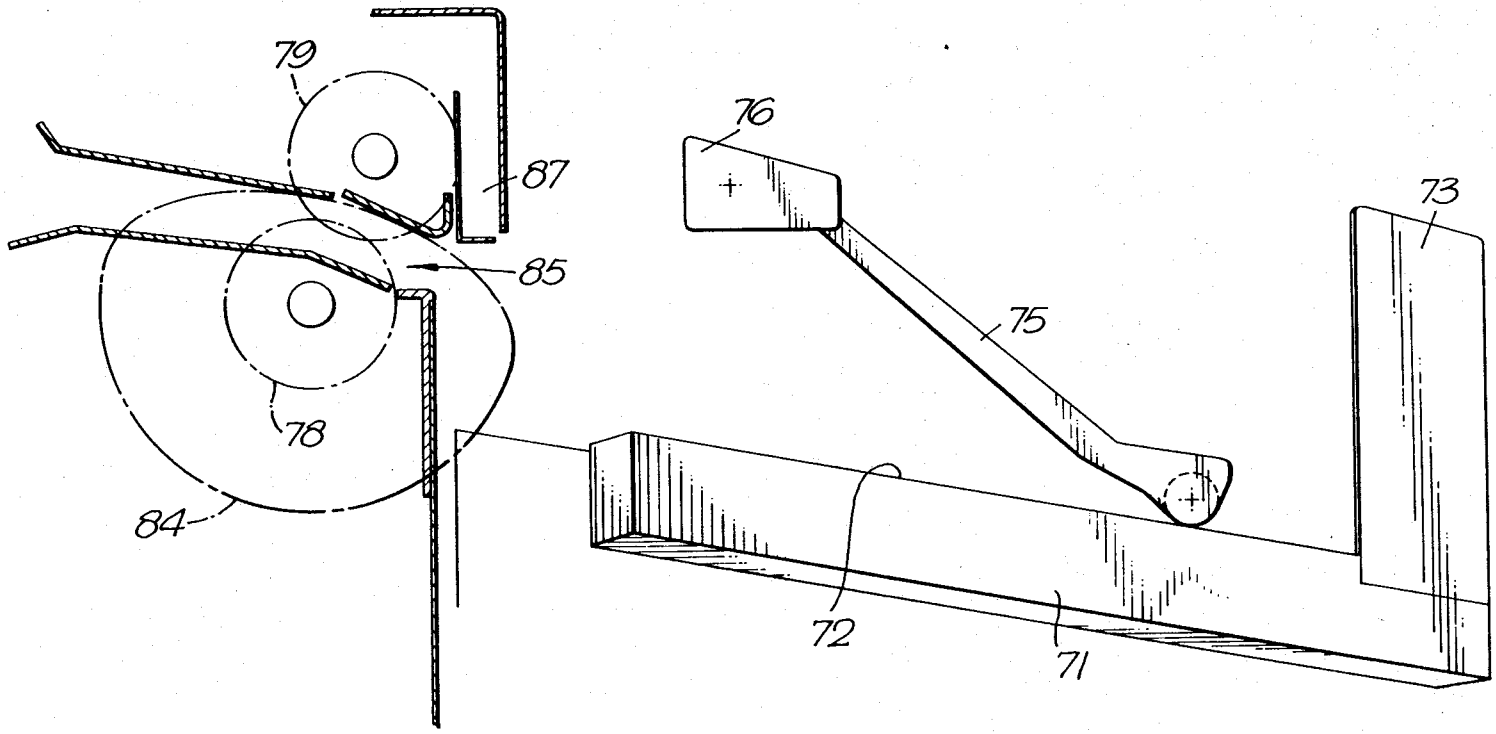
Figure 4:
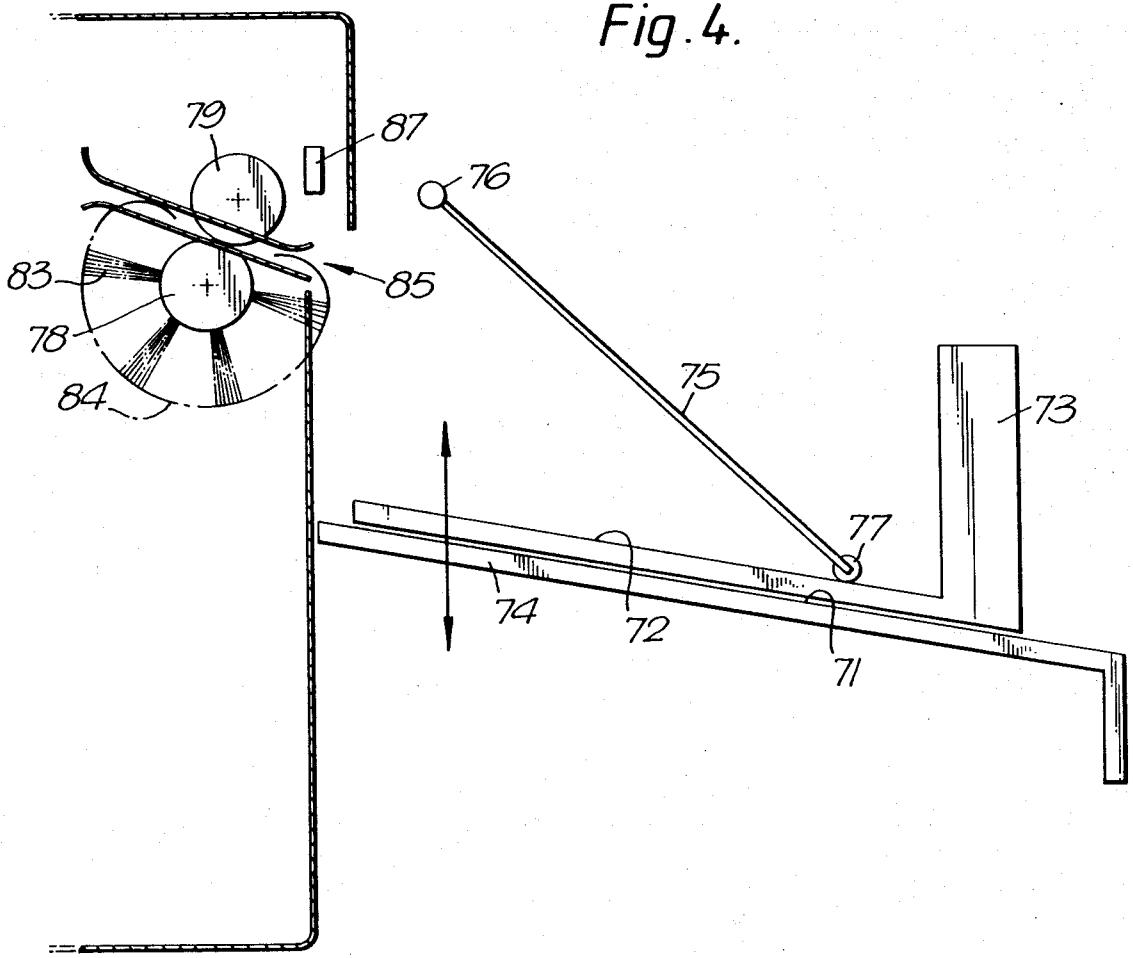
Figure 5:
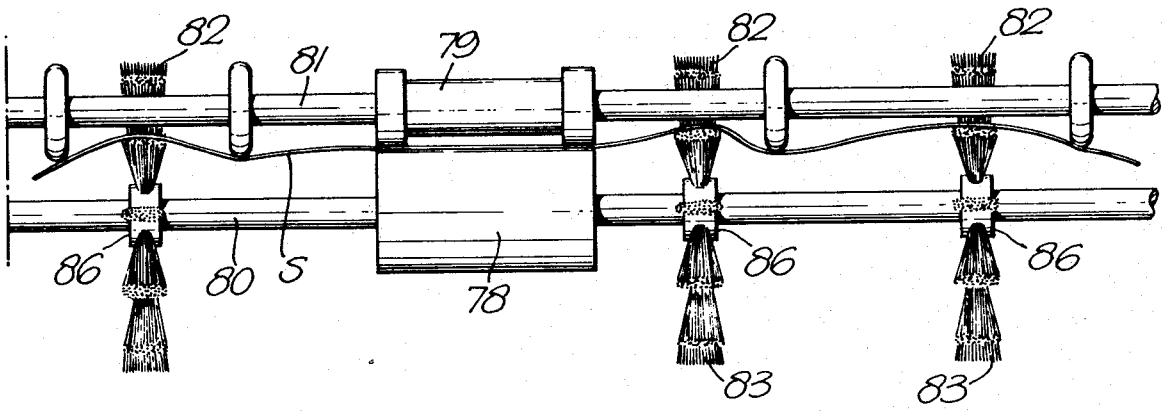
Figure 8:
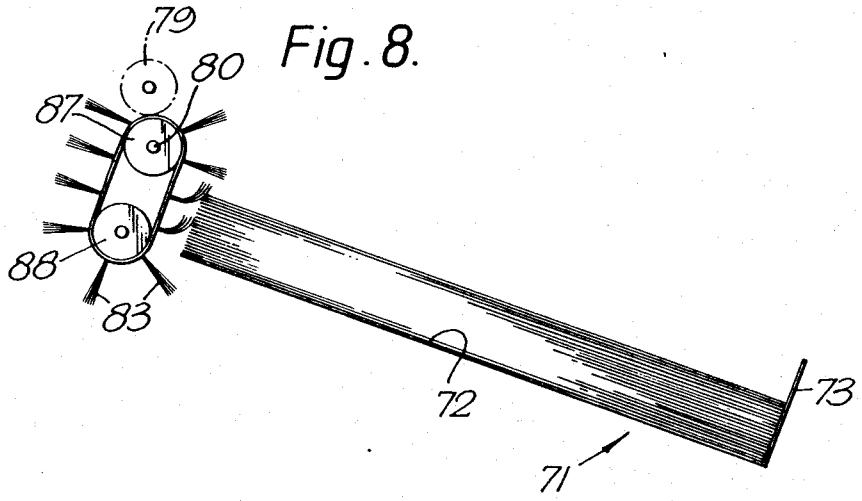
Figure 6:
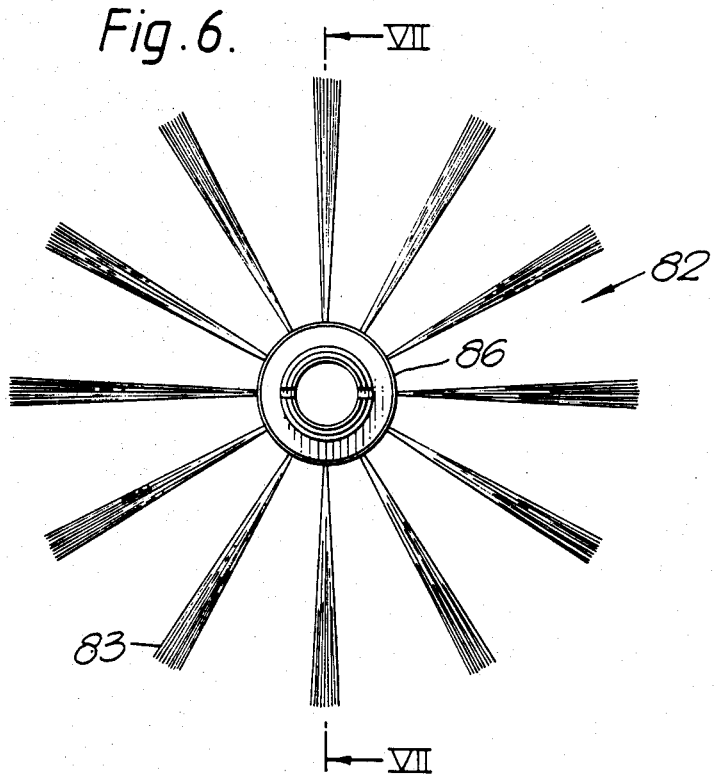
Figure 7:
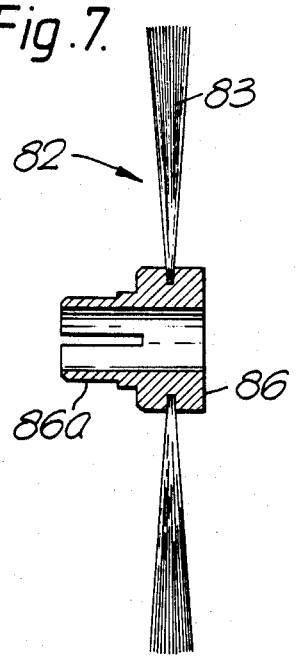
Figure 9:
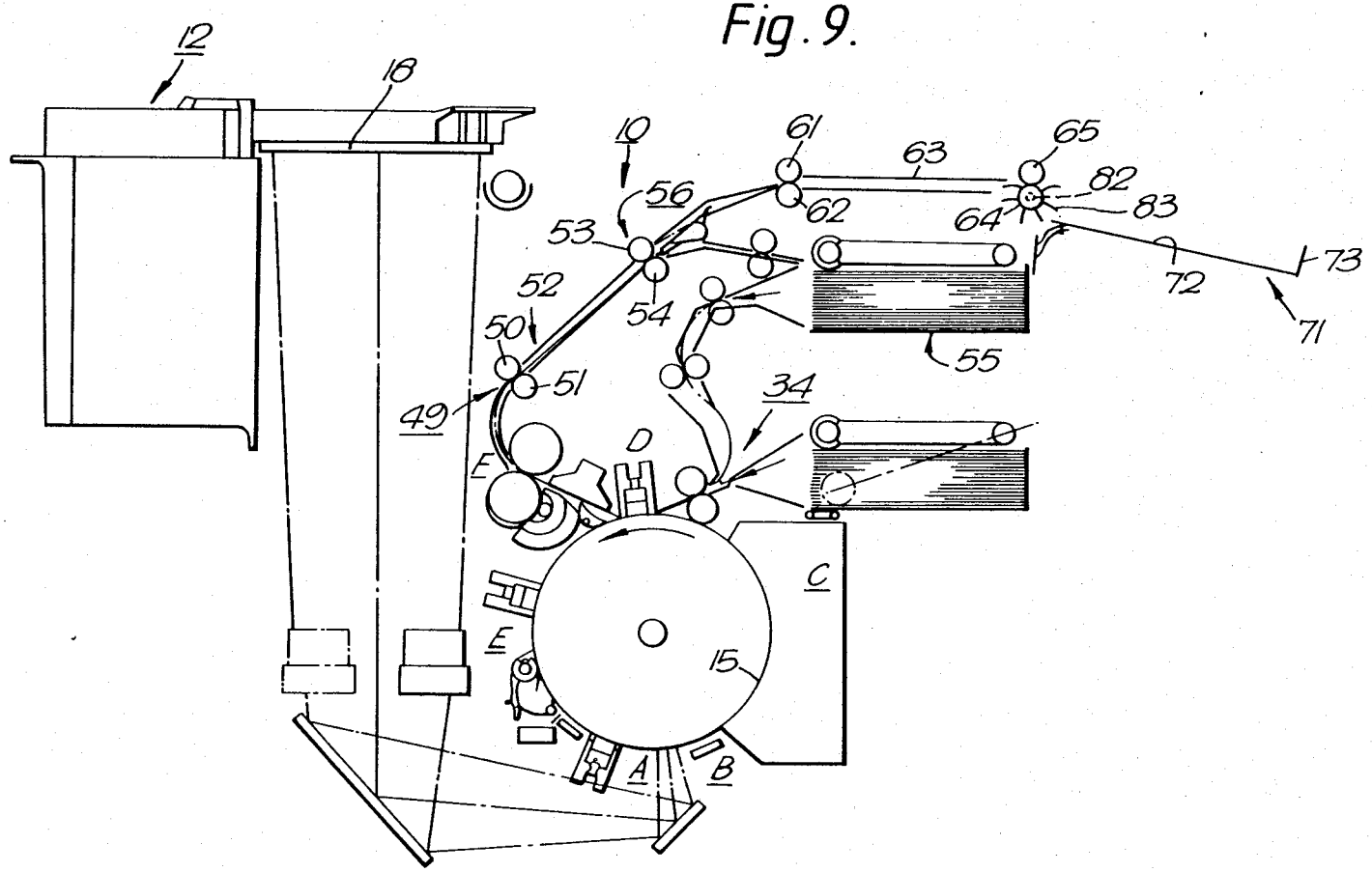

In order that the invention may be more readily understood, reference will now be made to the accompanying drawings, in which:

FIG. 1 schematically illustrates one embodiment of sheet stacker according to the invention mounted to receive sheets from a photocopier, FIG. 2 schematically illustrates the stacker mounted to receive sheets from a finisher for a photocopier, FIGS. 3 and 4 are side elevations of the stacker showing it in greater detail, FIG. 5 is partial end view of the stacker looking from the front, FIG. 6 is a side view of a brush utilised in the embodiment of FIGS. 3, 4 and 5, FIG. 7 is a cross-section through the brush on the line VII—VII of FIG. 6, FIG. 8 is a schematic illustration of another embodiment of stacker according to this invention, and FIG. 9 illustrates schematically a photocopier according to the invention.

Referring now to FIG. 1 there is shown a sheet stacker 70 according to this invention mounted to a sheet processor 10, such as a photocopier, which is schematically represented by the output nip rollers 64, 65 thereof. Sheets from the processor 10 are delivered to the stacker for collection. FIG. 2 shows the stacker mounted on a finisher 5 for the photocopier 10 which includes a compiler tray 6, a stitcher 7 for binding into sets sheets compiled on the tray 6 and output nip rollers 8, 9. Sheets may be compiled into sets and bound in the finisher 5 or conveyed straight through the finisher for stacking in the stacker 70. Thus the stacker can be used for compiling sheets into sets and for stacking sets ejected from the compiler tray 6. It will be understood that while a stacker as described and illustrated herein is particularly suitable for use with a photocopier and related equipment it may be used with any apparatus which processes cut sheets of paper.

Sheets from the output nip rollers 64, 65 of the processor or 8, 9 of the finisher pass to the stacker 70. As shown in FIGS. 3, 4 and 5, the stacker comprises a sheet collection tray 71 having a stack support surface 72 sloping downwardly towards a front end registration stop 73. The tray 71 is mounted on an elevating platform 74 the elevation of which is automatically adjustable in dependence upon stack height. A pair of damper arms 75 (only one of which is visible in FIGS. 3 and 4) overlie the support surface 72; they are mounted on a support 76 over the input end of the tray and project downstream towards their free ends which carry rollers 77 which rest on the top sheet of the stack being formed in the support surface. These rollers 77 are freely rotatable counterclockwise (as seen in FIGS. 3 and 4) to allow sheets to pass therebeneath towards the end stop 73 but are constrained against clockwise rotation to prevent the sheets from bouncing back off the end stop, as described in greater detail in our copending Application No. 511,035 (our case R/82002) filed concurrently herewith. The damper arms 75 also actuate a sensor switch (not shown) on the support 76 to activate the tray elevator mechanism to lower the tray 71 in steps as the stack builds up.

The tray 71 is also displaceable sideways for offsetting sheets being stacked fore-and-aft, i.e. towards and away from the entry end of the stacker, to accommodate sheets of different sizes.

At the input end of the stacker two pairs of input nip rollers 78, 79 are arranged on shafts 80, 81. The rollers 78, 79 are preferably foam rollers so that they can handle sets from a finisher as well as sheets. However where only sheets are being handled, solid rollers may be used. The nip rollers are arranged above the support surface 72 and as sheets enter the tray they drop down towards the surface 72. There is a tendency for the trail ends of the sheets which are curled not to settle properly and this tends to build up with successive sheets until the incoming sheets are obstructed even though the nominal capacity of the stacker has not been exceeded. In order to overcome this, a pair of spaced, rotatable brushes 82 are arranged side-by-side at the input end of this stacker. These brushes are driven clockwise (as seen in FIGS. 3 and 4) so as to wipe down against the trail ends of sheets received in the tray 71, their bristles 80 being of a sufficient length for this purpose.

Preferably the brushes are mounted on the lower nip roller shaft 80 for rotation therewith. With this arrangement the tips of the bristles 83 follow a squashed circular path as indicated by the dash-dot line 84. This shape of the path occurs because the bristles 83 wipe against the underside of a sheet passing through the nip rollers 78, 79. Such an arrangement has the following additional advantages. Firstly, the brushes tend to corrugate the sheet as seen from FIG. 5 because they have a larger diameter than the foam nip rollers 78, 79. The result of this is that the beam strength of the sheet is increased, thus facilitating its entry into the tray 71 and alleviating the problem which sometimes occurs of the lead edge curling under as the sheet enters the tray. Secondly, the brushes engage the trail edge of the sheet as it leaves the nip of rollers 78, 79 and assists in driving the sheet into the tray. It should further be noted that by wiping downwardly against the trail ends of the sheets, the brushes tend to increase the rate at which the sheets settle in the tray.

The bristles 83 should be sufficiently long to engage the trail ends of the sheet, suitably with an overlap of between 2 and 8 mm, prefrably 5 mm, and sufficient soft to produce a force on the trail end sufficient to press the sheet downwardly but without damaging the sheet. A downward force on the sheet of between 1 and 15 grams, preferably 3 grams, has been found suitable.

It will be seen from the drawings that until the stack reaches a certain height the brushes will not actually press the sheets positively against the top of the stack but they wipe all sheets downwardly towards the stack and will serve to keep all the sheets in the tray beneath the entry throat 85 of the stacker. The stack height should not rise above the centers of the brushes.

The bristles 83 are, as shown, preferably arranged in tufts. In the brush shown best in FIGS. 6 and 7 the brush has twelve tufts each containing between 200 and 480 bristles with nine out of the twelve tufts having between 280 and 400 bristles. The bristles may be made of natural or synthetic fibre and in the embodiment shown are made of a nylon, preferably Rilsan, the bristles or filaments being $0.15 \pm 0.02$ mm in diameter and about 39 mm long. The bristles are mounted on a hub 86 of plastics material which is a slide-fit over the nip roller shaft 80 and secured for rotation therewith by a spring clip (not shown) which encircles a slotted flange 86*a* of the hub to grip it against the shaft. The hub suitably has a diameter of 22 mm so that the overall diameter of the brush is 100 mm.

As mentioned above, the tray 71 is adjustable towards and away from the entry throat 85. This enables it to be positioned according to the size of the sheets being stacked so that the trail edge of a sheet will be in substantially the same position regardless of the sheet size. This ensures that different paper sizes can be acted upon by the brushes 82.

A static eliminator 87 is preferably arranged opposite the feed throat 85 to reduce the static forces on the sheets for improved handling of the sheets.

In another embodiment shown in FIG. 8 the brushes 82 comprise endless belts, bands or the like having the bristles 83 projecting generally normally, outwardly therefrom. These brushes are arranged so as to extend normally to the stack support surface 72 and may as shown extend the full height of the stack. In the form illustrated the belts are entrained over rollers 87 on the lower nip roller shaft 80 and rollers 88 spaced below the rollers 87.

In the embodiments described above, the input nip rollers 78, 79 form part of the stacker itself. It is to be understood however that they may instead form the exit nip rollers of the sheet processor itself. FIG. 9 shows just such an embodiment of photocopier which may be adapted to accept various forms of sheet collection device. The copier 10 illustrated is capable of producing either simplex or duplex copies in sets from a wide variety of originals which may be advanced in recirculating fashion by a recirculating document apparatus 12 such as described in U.S. Pat. No. 3,556,512.

The processor 10 includes a photosensitive drum 15 which is rotated in the direction indicated so as to pass sequentially through a series of xerographic processing stations: a charging station A, an imaging station B, a developer station C, a transfer station D and a cleaning station E.

A document to be reproduced is transported by document handling apparatus 12 from the bottom of a stack to a platen 18 and scanned by means of a moving optical scanning system to produce a flowing light image on the drum at B. Cut sheets of paper are moved into the transfer station D from sheet registering apparatus 34 in synchronous relation with the image on the drum surface. The copy sheet is stripped from the drum surface and directed to a fusing station F. Upon leaving the fuser, the fixed copy sheet is passed through a curvilinear sheet guide system, generally referred to as 49, incorporating advancing rolls 50 and 51. The advancing rolls forward the sheet through a linear sheet guide system 52 and to a second pair of advancing rollers 53 and 54. At this point, depending on whether simplex or duplex copies are desired, the simplex copy sheet is either forwarded directly to the output nip rollers 64, 65 of the copier via pinch rolls 61, 62 or into upper supply tray 55 by means of a movable sheet guide 56. Movable sheet guide 56, and associated advancing rolls, are prepositioned by appropriate machine logic system to direct the individual sheets into the desired path.

A removable tray 71 having a base or support surface 72 inclined downwardly in the direction of sheet travel towards a registration stop 73 is mounted to the photocopier to receive sheets from the output nip rollers 64, 65, which are arranged to receive sheets fed along path 63 by pinch rolls 61, 62. Brushes 82 like those described above in relation to FIGS. 3 to 7 are mounted in the shaft 66 of the lower nip rollers 64 so as to wipe against the trail ends of sheets received in the tray 71.

Although specific embodiments of the invention have been described, it will be understood that various modifications may be made to to specific details referred to herein without departing from the scope of the invention as defined in the appended claims. For example, although stackers employing lead-edge registration have been described the invention is also applicable to trail-edge registration stackers.

I claim:

1. A sheet processor apparatus adapted to place images of a document onto a copy sheet and transport the copy sheet to an exit portion of the processor, nip means positioned within said processor and adjacent said exit portion of said processor and adapted to transport the copy sheet through said exit portion and into a registration stop that aligns the edges of the sheet within a sheet collection device, said nip means including one or more brushes adapted to serve as a means for guiding the copy sheet through said nip means and subsequently engage the trail edge of the copy sheet and drive it out of said exit portion and into said registration stop of said collection device, and wherein said brushes are adapted to wipe down against trail ends of copy sheets stacked in said collection device to compact the copy sheets in order to increase the capacity of said collection device for receiving upcurled sheets.

2. The apparatus of claim 1, wherein said brushes are mounted on a belt and adapted to wipe down against trail ends of the complete height of copy sheets stacked within said collecting tray.

3. The apparatus of claim 2, wherein said nip means includes a pair of foam rollers and wherein said brushes have a larger diameter than said foam rollers in order to corrugate a copy sheet passing therethrough.

4. A sheet collection device for receiving in a stack sheets conveyed thereto, comprising a stack support surface, a registration stop connected to said support surface for aligning the edges of sheets received on the support surface and one or more brushed arranged at the input end of the support surface, said brushes being adapted to drive sheets against said registration stop and contact the ends of sheets stacked against said support surface to compress upcurled ends of the sheets against said support surface in order to increase the sheet stacking capacity of said collection device.

5. The collection device of claim 4, wherein said brushes are supported by a belt positioned adjacent the input end of said support surface.

* * * * *